US011315512B2

(12) United States Patent
Tao et al.

(10) Patent No.: US 11,315,512 B2
(45) Date of Patent: Apr. 26, 2022

(54) GOA CIRCUIT AND DISPLAY PANEL THEREOF

(71) Applicant: Wuhan China Star Optoelectronics Technology Co., Ltd., Hubei (CN)

(72) Inventors: Jian Tao, Wuhan (CN); Yafeng Li, Wuhan (CN); Bo Yang, Wuhan (CN)

(73) Assignee: Wuhan China Star Optoelectronics Technology Co., Ltd., Wuhan (CN)

( * ) Notice: Subject to any disclaimer, the term of this patent is extended or adjusted under 35 U.S.C. 154(b) by 150 days.

(21) Appl. No.: 16/652,167

(22) PCT Filed: Mar. 24, 2020

(86) PCT No.: PCT/CN2020/080773
§ 371 (c)(1),
(2) Date: Mar. 30, 2020

(87) PCT Pub. No.: WO2021/159586
PCT Pub. Date: Aug. 19, 2021

(65) Prior Publication Data

US 2021/0407451 A1 Dec. 30, 2021

(30) Foreign Application Priority Data

Feb. 12, 2020 (CN) ..... 202010088146.1

(51) Int. Cl.
*G09G 5/00* (2006.01)
*G09G 3/36* (2006.01)

(52) U.S. Cl.
CPC ... *G09G 3/3674* (2013.01); *G09G 2300/0408* (2013.01); *G09G 2310/08* (2013.01)

(58) Field of Classification Search
CPC ..... G09G 3/3266; G09G 3/36; G09G 3/3674; G09G 3/3677; G09G 2300/0408; G09G 2310/08
See application file for complete search history.

(56) References Cited

U.S. PATENT DOCUMENTS

| | | | | |
|---|---|---|---|---|
| 9,916,805 | B2 * | 3/2018 | Li | G09G 3/3696 |
| 9,928,795 | B2 | 3/2018 | Gong | |
| 9,933,889 | B2 | 4/2018 | Xiao et al. | |
| 10,043,473 | B2 | 8/2018 | Li | |
| 10,078,993 | B2 * | 9/2018 | Li | G11C 19/28 |
| 10,109,251 | B2 * | 10/2018 | Shi | G09G 3/3696 |
| 10,249,246 | B2 | 4/2019 | Li | |

(Continued)

FOREIGN PATENT DOCUMENTS

| | | | |
|---|---|---|---|
| CN | 101937718 | A | 1/2011 |
| CN | 105513550 | A | 4/2016 |

(Continued)

*Primary Examiner* — Joe H Cheng
(74) *Attorney, Agent, or Firm* — Luedeka Neely Group, P.C.

(57) ABSTRACT

A gate driver on array (GOA) circuit is provided. The GOA circuit includes a plurality of cascading GOA units. One of the GOA unit includes: a scan control module, an anti-backfill module connected to a constant high-level signal and the scan control module, a cascading reset module, and a gate signal output module. Base on functions of prior art solution, the provided GOA circuit of the disclosure reduces two types of signal to simplify signal traces at the bezel to realize a narrow bezel design.

20 Claims, 8 Drawing Sheets

(56) References Cited

U.S. PATENT DOCUMENTS

| | | | | |
|---|---|---|---|---|
| 10,339,870 | B2 | 7/2019 | Li | |
| 2011/0002438 | A1 | 1/2011 | Kim | |
| 2016/0372031 | A1* | 12/2016 | Li | G11C 19/28 |
| 2017/0193956 | A1* | 7/2017 | Xiao | G02F 1/136204 |
| 2018/0211626 | A1* | 7/2018 | Shi | G09G 3/3677 |
| 2019/0122625 | A1* | 4/2019 | Pu | G09G 3/3677 |
| 2020/0226995 | A1* | 7/2020 | Dai | G02F 1/136286 |

FOREIGN PATENT DOCUMENTS

| | | | | |
|---|---|---|---|---|
| CN | 105629601 | A | | 6/2016 |
| CN | 106128379 | A | | 11/2016 |
| CN | 106486075 | A | | 3/2017 |
| CN | 106782374 | A | | 5/2017 |
| CN | 111312177 | A | * | 6/2020 |

* cited by examiner

GOA CIRCUIT AND DISPLAY PANEL THEREOF

This application is the National Stage of PCT/CN2020/080773 filed on Mar. 24, 2020, which claims priority to Chinese Application No. 202010088146.1 filed on February 12, 2020, the disclosure of which is incorporated by reference in its entirety.

FIELD

The present disclosure relates to display technologies, particularly, to gate driving technologies, and more particularly, to a gate driver on array (GOA) circuit and a display panel thereof.

BACKGROUND

A gate driver on array (GOA) circuit uses an existing array manufacturing process in a thin-film transistor liquid crystal display to produce a gate row scanning drive signal circuit on an array substrate to realize a line-by-line gate scan driving technology.

As shown in FIG. 1, the GOA circuit in a traditional technical solution includes multiple cascading GOA sub-circuits. Among them, the Nth GOA sub-circuit needs to use a variety of signals including a forward scan DC control signal U2D, a backward scan DC control signal D2U, a constant high-level signal VGH, a constant low-level signal VGL, a (N−1)th stage gate drive signal G(N−1), a (N+1)th stage gate drive signal G(N+1), a Nth stage clock signal CK(N), a (N+1)th stage clock signal CK(N+1), a reset signal Reset, and a setting signal GAS, which increase types of signals that the GOA circuit needs and increase signal traces in the bezel area, which is not conducive to achieving a narrow bezel.

SUMMARY

In view of the above, the present disclosure provides a gate driver on array (GOA) circuit to resolve issues of a variety of signals of GOA circuit, which are not conducive to achieving a narrow bezel.

In order to achieve above-mentioned object of the present disclosure, one embodiment of the disclosure provides a GOA circuit, including a plurality of cascading GOA units. one of the GOA unit includes: a scan control module configured to control a first driving signal output from the scan control module to receive a constant high-level signal according to a (N−1)th gate driving signal and a (N+1)th gate driving signal; an anti-backfill module connected to the constant high-level signal and the scan control module and configured to obtain a second driving signal from the first driving signal according to control of the constant high-level signal; a cascading reset module connected to a constant low-level signal, a (N−2)th clock signal, the constant high-level signal, the scan control module, and the anti-backfill module and configured to pull down an electrical level of the first driving signal to an electrical level of the constant low-level signal according to the (N−2)th clock signal and configured to output a cascading reset signal; and a gate signal output module connected to an Nth clock signal, the constant low-level signal, the anti-backfill module, and the cascading reset module and configured to output an Nth gate driving signal according to the second driving signal and the cascading reset signal.

In one embodiment of the disclosure, the GOA unit further includes a first pull-down module. The first pull-down module is connected to the scan control module, the cascading reset module, and the constant low-level signal, and configured to pull down an electrical level of the cascading reset signal to the electrical level of the constant low-level signal.

In one embodiment of the disclosure, the GOA unit further includes a second pull-down module. The second pull down module is connected to the scan control module, the constant low-level signal, and the cascading reset module and configured to pull down the electrical level of the first driving signal to the electrical level of the constant low-level signal.

In one embodiment of the disclosure, the GOA unit further includes a system reset module. The system reset module is connected to the cascading reset module and configured to pull up an electrical level of the cascading reset signal to an electrical level of a system reset signal according to the system reset signal.

In one embodiment of the disclosure, the GOA unit further includes a system setting module. The system setting module is connected to the gate signal output module and the constant low-level signal. The system setting module is configured to pull an electrical level of the Nth gate driving signal to the electrical level of the constant low-level signal according to a system setting signal.

In one embodiment of the GOA circuit, the scan control module includes a first transistor and a second transistor. The constant high-level signal is connected to a drain of the first transistor and a drain of the second transistor. The (N−1)th gate driving signal is connected to a gate of the first transistor. The (N+1)th gate driving signal is connected to a gate of the second transistor. A source of the first transistor and a source of the second transistor are connected together to output the first driving signal.

In one embodiment of the GOA circuit, the anti-backfill module includes a third transistor. A drain of the third transistor is connected to the source of the first transistor. A gate of the third transistor is connected to the constant high-level signal. A source of the third transistor is configured to output the second driving signal.

In one embodiment of the GOA circuit, the cascading reset module includes a fourth transistor and a fifth transistor. The constant low-level signal is connected to a drain of the fourth transistor. A source of the fourth transistor is connected to the source of the first transistor. The constant high-level signal is connected to a drain of the fifth transistor. A source of the fifth transistor is configured to output the cascading reset signal. The (N−2)th clock signal is connected to a gate of the fourth transistor and a gate of the fifth transistor.

In one embodiment of the GOA circuit, the gate signal output module includes a sixth transistor and a seventh transistor. The source of the third transistor is connected to a gate of the sixth transistor. The Nth clock signal is connected to a drain of the sixth transistor. A source of the sixth transistor is connected to a drain of the seventh transistor to output the Nth gate driving signal. A gate of the seventh transistor is connected to the source of the fifth transistor. A source of the seventh transistor is connected to the constant low-level signal.

Another embodiment of the disclosure provides a display panel, including the abovementioned GOA circuit.

In comparison with prior art, the GOA circuit reduces two types of signal to simplify signal traces at the bezel to realize a narrow bezel design base on functions of prior art solution.

DETAILED DESCRIPTION

The following description of the embodiments is provided by reference to the drawings and illustrates the specific embodiments of the present disclosure. Directional terms mentioned in the present disclosure, such as "up," "down," "top," "bottom," "forward," "backward," "left," "right," "inside," "outside," "side," "peripheral," "central," "horizontal," "peripheral," "vertical," "longitudinal," "axial," "radial," "uppermost" or "lowermost," etc., are merely indicated the direction of the drawings. Therefore, the directional terms are used for illustrating and understanding of the application rather than limiting thereof.

Figure 1:
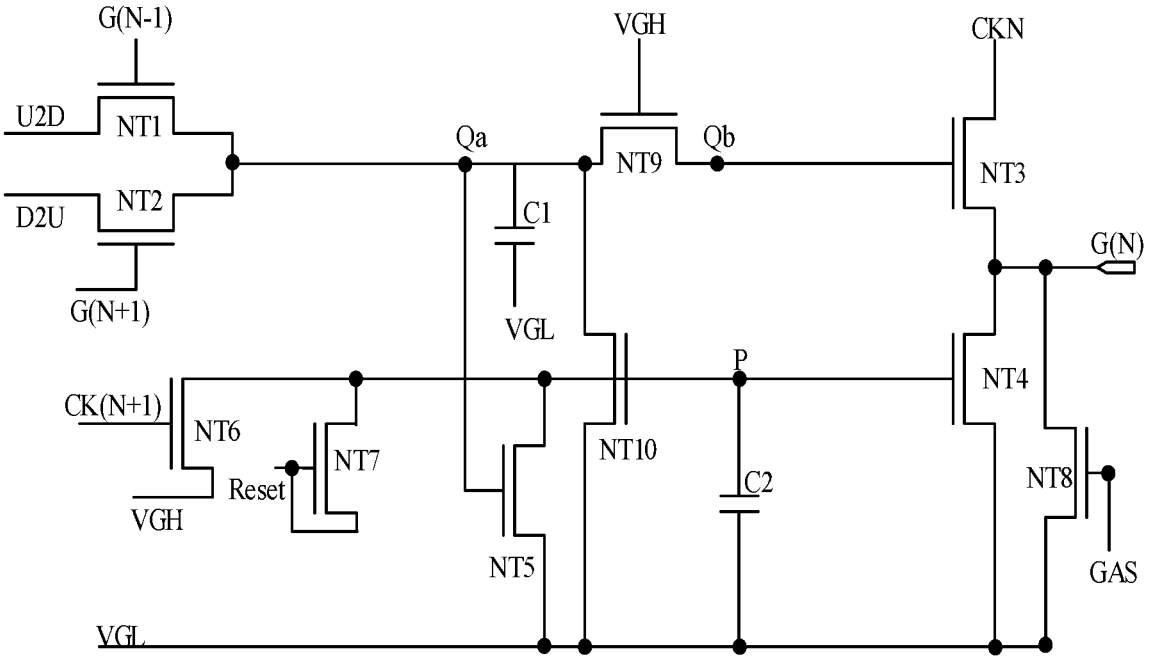
FIG. 1 is a schematic view of a circuit schematic of a gate driver on array (GOA) sub-circuit of a GOA circuit according to prior art.

In order to understand the difference between the present disclosure and the conventional technical solution more clearly, the traditional technical solution is described with reference to FIGS. 1 and 2. The working sequence of a gate driver on array (GOA) circuit shown in FIG. 1 is divided into following stages:

Before stage 1: a reset signal Reset will set to be high before a frame starting. A seventh transistor NT7 is turned on. An electrical level of a point P is pulled up in advance. A tenth transistor NT10 and a fourth transistor NT4 are turned on. An electrical level of a point Qb and an electrical level of a point Qa are pulled down in advance. An initial electrical level of a Nth gate driving signal G(N) is the same with an electrical level of a constant low-level signal VGL. Then, the reset signal Reset is set to be low, the seventh transistor NT7 is turned off until the moment of t1.

At stage t1: a (N−1)th gate driving signal G(N−1) changes to high level to turn on a first transistor NT1. A constant high-level VGH is inputted to pull up the electrical level of the point Qb, and the point Qa. A capacitor C1 is charged. A third transistor NT3 is turned on. A fifth transistor NT5 is turned on. The electrical level of the point P is pulled down. The fourth transistor NT4 and the tenth transistor NT10 are turned off.

At stage t2: the (N−1)th gate driving signal G(N−1) changes to low level. The first transistor NT1 is turned off. Electrical levels of the point Qb and the point Qa are still high because there has no leakage path. The electrical level of the point Qb is more stable because of existence of capacitor C1. A Nth clock signal CK(N) is at a high electrical level. The Nth gate driving signal G(N) outputs a high electrical level.

At stage t3: a (N+1)th clock signal CK(N+1) and a (N+1)th gate driving signal G(N+1) change to be high level. A sixth transistor NT6 is turned on. The electrical level of the point P is pulled up. A capacitor C2 is charged. The fourth transistor NT4 is turned on. The Nth gate driving signal G(N) is pulled down to the electrical level of the constant low-level signal VGL. Meanwhile, a second transistor NT2 and the tenth transistor NT10 are turned on. A fifth transistor NT5 is turned off. The electrical levels of the point Qa and the electrical, the point Qb, and the capacitor C1 are pulled down to the same electrical level of the constant low-level signal VGL.

After stage t3: because of existence of the capacitor C2 and the capacitor C1, the capacitor C2 will keep the same electrical level of the constant high-level signal VGH, and the capacitor C1 will keep the same electrical level of the constant low-level signal VGL to keep the fourth transistor NT4 turned on and to keep the third transistor NT3 turned off. The Nth gate driving signal G(N) is keeping at the same electrical level of the constant low-level signal VGL.

When output of the Nth gate driving signal G(N) is end, it needs to wait for arrival of the (N+1)th clock signal CK(N+1). It needs time for an electrical level of a gate of the fourth transistor NT4 to charge to totally turned on the fourth transistor NT4 because of existence of the capacitor C2 and a parasitic capacitance of the fourth transistor NT4 itself. The electrical level of the Nth gate driving signal G(N) cannot drop from the electrical level the same as the constant high-level signal VGH down to the electrical level the same as the constant low-level signal VGL rapidly. If a charge period of the pixel is shorter, it will cause a crosstalk because the Nth gate driving signal G(N) has not turned off yet due to the abovementioned delay when a data signal from a source driver changed. Meanwhile, the Nth gate driving signal G(N), also takes as a cascading transmission signal of GOA circuit, will cause a risk of reliability of a product with thousands of cascading transmissions.

The GOA circuit provided in the disclosure can be integrated on an array substrate as a liquid crystal display line scan (gate) driving circuit to drive a pixel switch.

The GOA circuit provided in the disclosure can be applied to a gate driving field of mobile phones, displays, and televisions.

The GOA circuit provided in the disclosure can be applied to a line driving technology in a liquid crystal display (LCD) and an organic electroluminescent display (OLED).

A stability of the GOA circuit provided by the disclosure is suitable for high-resolution display panel design.

Figure 3:
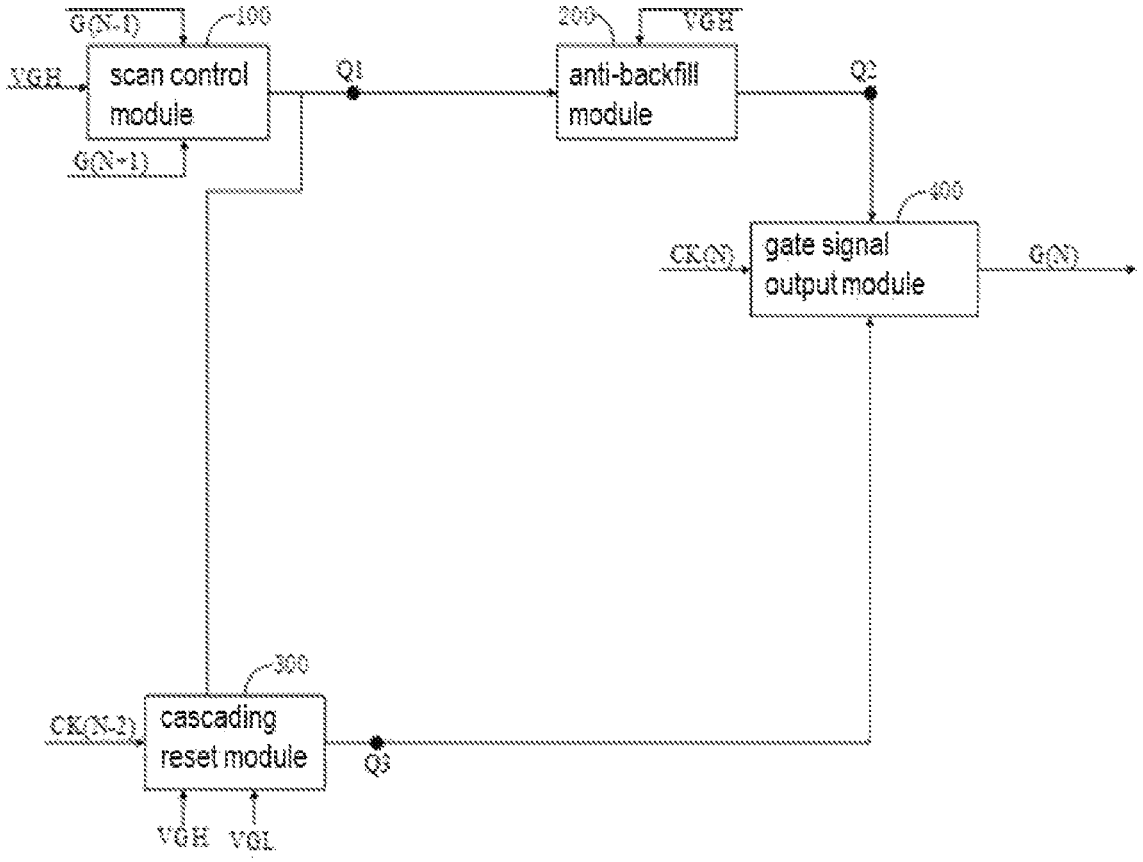
FIG. 3 is a schematic view of a first type of structure of a GOA unit of a GOA circuit according to an embodiment of the present disclosure.

Referring to FIG. 3, one embodiment of the disclosure provides a GOA circuit, including a plurality of cascading GOA units. one of the GOA unit includes: a scan control module 100 configured to control a first driving signal Q1 output from the scan control module 100 to receive a constant high-level signal VGH according to a (N−1)th gate driving signal G(N−1) and a (N+1)th gate driving signal (N+1); an anti-backfill module 200 connected to the constant high-level signal VGH and the scan control module 100 and configured to obtain a second driving signal Q2 from the first driving signal Q1 according to control of the constant high-level signal VGH; a cascading reset module 300 connected to a constant low-level signal VGL, a (N−2)th clock signal CK(N−2), the constant high-level signal VGH, the scan control module 100, and the anti-backfill module 200 and configured to pull down an electrical level of the first driving signal Q1 to an electrical level of the constant low-level signal VGL according to the (N−2)th clock signal CK(N−2) and configured to output a cascading reset signal Q3; and a gate signal output module 400 connected to an Nth clock signal CK(N), the constant low-level signal VGL, the anti-backfill module 200, and the cascading reset module 300 and configured to output an Nth gate driving signal G(N) according to the second driving signal Q2 and the cascading reset signal Q3.

In detail, when any one of the (N−1)th gate driving signal G(N−1) and the (N+1)th gate driving signal G(N+1) is at high level, the first driving signal Q1 output from the scan control module 100 is as the constant high-level signal VGH. The anti-backfill module 200 keeps turning on under control of the constant high-level signal VGH to prevent the second driving signal Q2 from back to the first driving signal Q1. It is good for keeping electrical level of the second driving signal Q2 to reduce voltage drop here. The second driving signal Q2 controls the gate signal output module 400, that is, control whether the Nth gate driving signal G(N) receiving the Nth clock signal CK(N). The (N−2)th clock signal CK(N−2) controls the cascading reset module 300. When (N−2)th clock signal CK(N−2) is high level, a cascading reset signal Q3 output from the cascading reset module 300 controls the gate signal output module 400 to pull down the electrical level of the Nth gate driving signal G(N) to the same electrical level of the constant low-level signal VGL, and to pull down the electrical level of the first driving signal Q1 to the same electrical level of the constant low-level signal VGL at the same time.

Signals need in the GOA unit of the disclosure includes the constant high-level signal VGH, the constant low-level signal VGL, the (N−1)th gate driving signal G(N−1), the (N+1)th gate driving signal G(N+1), the (N−2)th clock signal CK(N−2), and the Nth clock signal CK(N). In comparison with prior art in FIG. 1, the disclosure replaces a forward scan DC control signal U2D and a backward scan DC control signal D2U with the constant high-level signal VGH to reduce types of signal required by the GOA unit, reduce types of signal required by the GOA circuit, and reduce signal traces at the bezel to realize a narrow bezel design Referring to FIG. 4, in one embodiment of the disclosure, the GOA unit further includes a first pull-down module 500. The first pull-down module 500 is connected to the scan control module 100, the cascading reset module 300, and the constant low-level signal VGL, and configured to pull down an electrical level of the cascading reset signal Q3 to the electrical level of the constant low-level signal VGL.

In detail, the embodiment does not add any type of signal required by the GOA circuit. The first pull down module 500 ensures the gate signal output module 400 from affection of cascading reset signal Q3 when the gate signal output module 400 receives the Nth clock signal CK(N). This enhances working reliability.

Figure 4:
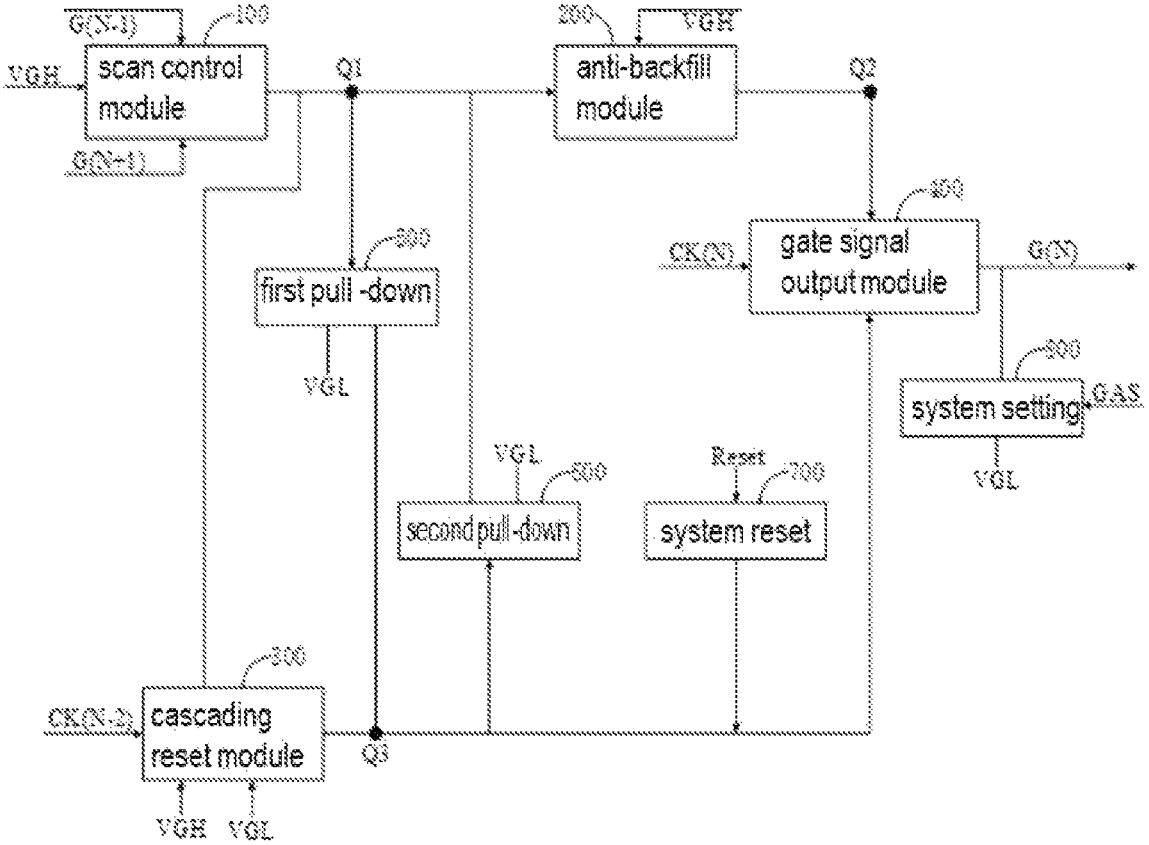
FIG. 4 is a schematic view of a second type of structure of a GOA unit of a GOA circuit according to an embodiment of the present disclosure.

Referring to FIG. 4, in one embodiment of the disclosure, the GOA unit further includes a second pull-down module 600. The second pull down module 600 is connected to the scan control module 100, the constant low-level signal VGL, and the cascading reset module 300 and configured to pull down the electrical level of the first driving signal Q1 to the electrical level of the constant low-level signal VGL.

In detail, the embodiment does not add any type of signal required by the GOA circuit. The second pull-down module 600 ensures the gate signal output module 400 from receiving the Nth clock signal CK(N) to avoid signal crosstalk and to ensure working reliability of the GOA circuit when the cascading reset signal Q3 is at high level, that is, the cascading resetting is enable.

Referring to FIG. 4, in one embodiment of the disclosure, the GOA unit further includes a system reset module 700. The system reset module 700 is connected to the cascading reset module 300 and configured to pull up an electrical level of the cascading reset signal Q3 to an electrical level of a system reset signal Reset according to the system reset signal Reset.

In comparison with prior art in FIG. 1, the GOA circuit in the embodiment adds the system reset signal Reset. The numbers of types of signals required by the GOA circuit are still less to reduce signal traces at the bezel. The system reset module 700 pulls down the electrical levels of all the gate driving signals in the GOA circuit according to one system reset signal Reset. When the system reset signal Reset is at high level, the cascading reset signal Q3 is pulled up to high level. When the system reset signal Reset is at low level, the system reset signal Reset is at an invalid state.

Referring to FIG. 4, in one embodiment of the disclosure, the GOA unit further includes a system setting module 800. The system setting module 800 is connected to the gate signal output module 400 and the constant low-level signal VGL. The system setting module 800 is configured to pull an electrical level of the Nth gate driving signal G(N) down to the electrical level of the constant low-level signal VGL according to a system setting signal GAS.

In comparison with prior art in FIG. 1, the GOA circuit in the embodiment adds the system setting signal GAS. The numbers of types of signals required by the GOA circuit are still less to reduce signal traces at the bezel. The system setting signal GAS takes the high level as an enabling state, but the disclosure is not limit to this. The system setting module 800 pulls down all the gate driving signals in the GOA circuit according to one system setting signal GAS.

Figure 5:
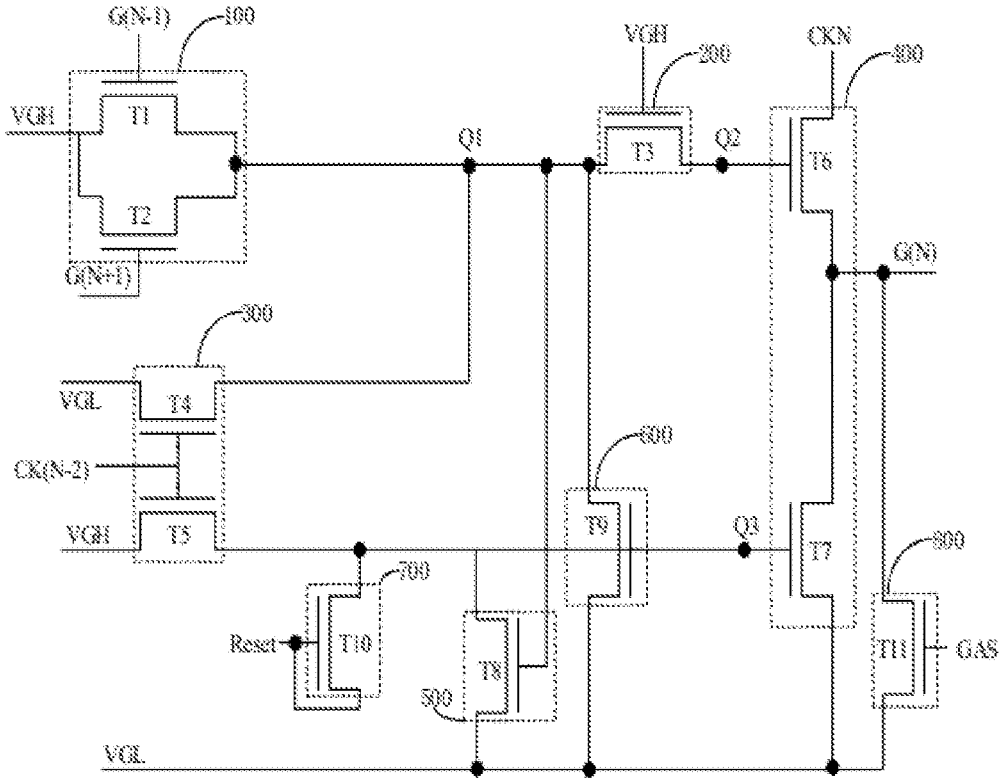
FIG. 5 is a schematic view of a circuit schematic of the GOA unit of the GOA circuit according to FIG. 4.

Referring to FIG. 5, in one embodiment of the GOA circuit, the scan control module 100 includes a first transistor T1 and a second transistor T2. The constant high-level signal VGH is connected to a drain of the first transistor T1 and a drain of the second transistor T2. The (N−1)th gate driving signal G(N−1) is connected to a gate of the first transistor T1. The (N+1)th gate driving signal G(N+1) is connected to a gate of the second transistor T2. A source of the first transistor T1 and a source of the second transistor T2 are connected together to output the first driving signal Q1.

Referring to FIG. 5, in one embodiment of the GOA circuit, the anti-backfill module 200 includes a third transistor T3. A drain of the third transistor T3 is connected to the source of the first transistor T1. A gate of the third transistor T3 is connected to the constant high-level signal VGH. A source of the third transistor T3 is configured to output the second driving signal Q2.

Referring to FIG. 5, in one embodiment of the GOA circuit, the cascading reset module 300 includes a fourth transistor T4 and a fifth transistor T5. The constant low-level signal VGL is connected to a drain of the fourth transistor T4. A source of the fourth transistor T4 is connected to the source of the first transistor T1. The constant high-level signal VGH is connected to a drain of the fifth transistor T5. A source of the fifth transistor T5 is configured to output the cascading reset signal Q3. The (N−2)th clock signal CK(N−2) is connected to a gate of the fourth transistor T4 and a gate of the fifth transistor T5.

Referring to FIG. 5, in one embodiment of the GOA circuit, the gate signal output module 400 includes a sixth transistor T6 and a seventh transistor T7. The source of the third transistor T3 is connected to a gate of the sixth transistor T6. The Nth clock signal CK(N) is connected to a drain of the sixth transistor T6. A source of the sixth transistor T6 is connected to a drain of the seventh transistor T7 to output the Nth gate driving signal G(N). A gate of the seventh transistor T7 is connected to the source of the fifth transistor T5. A source of the seventh transistor T7 is connected to the constant low-level signal VGL.

Referring to FIG. 5, in one embodiment of the GOA circuit, the first pull-down module 500 includes an eighth transistor T8. A drain of the eighth transistor T8 is connected to the source of the fifth transistor T5, a source of the eighth transistor T8 is connected to the constant low-level signal VGL, and a gate of the eighth transistor T8 is connected to the source of the first transistor T1.

Referring to FIG. 5, in one embodiment of the GOA circuit, the second pull-down module 600 includes a ninth transistor T9. A drain of the ninth transistor T9 is connected to the source of the first transistor T1, a source of the ninth transistor T9 is connected to the constant low-level signal VGL, and a gate of the ninth transistor T9 is connected to the source of the fifth transistor T5.

Referring to FIG. 5, in one embodiment of the GOA circuit, the system reset module 700 includes a tenth transistor T10. The system reset signal Reset is connected to a drain of the tenth transistor T10 and a gate of the tenth transistor T10. A source of the tenth transistor T10 is connected to the source of the fifth transistor T5.

Referring to FIG. 5, in one embodiment of the GOA circuit, the system setting module 800 includes an eleventh transistor T11. A drain of the eleventh transistor T11 is connected to the source of the sixth transistor T6, a source of the eleventh transistor T11 is connected to the constant low-level signal VGL, and a gate of the eleventh transistor T11 is configured to receive the system setting signal GAS.

Figure 6:
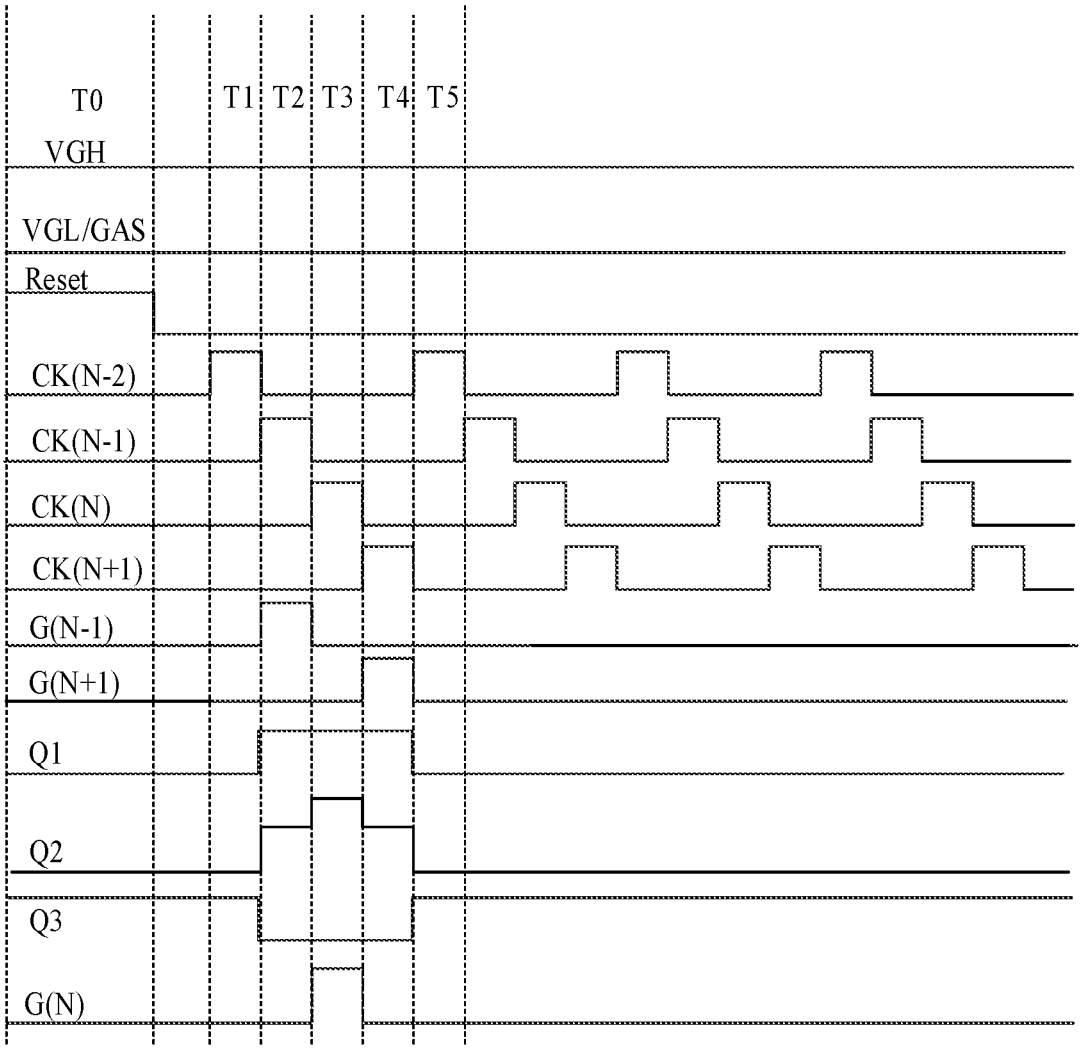
FIG. 6 is a schematic view of a time sequence of the GOA sub-circuit of the GOA circuit according to FIG. 5.

Referring to FIG. 6, in one embodiment of the disclosure, a working sequence of the GOA circuit in FIG. 5 are as follow stages:

At stage T0: a reset signal Reset will set to be high before a frame starting. The tenth transistor T10 is turned on. An electrical level of cascading reset signal Q3 is pulled up in advance. A seventh transistor T7 and a ninth transistor T9 are turned on. An electrical level of the first driving signal Q1 and an electrical level of the second driving signal Q2 are pulled down in advance. All initial electrical levels of gate driving signal are the same with an electrical level of a constant low-level signal VGL.

At stage T1: a (N−2)th clock signal CK(N−2) is at high level to turn on the fourth transistor T4 and the fifth transistor T5. A constant low-level VGL pulls down the electrical level of the first driving signal Q1 and the second driving signal Q2, and the sixth transistor T6 and the eighth transistor T8 are turned off after the fourth transistor T4 is turned on. The electrical level of the cascading reset signal Q3 is pulled up to the same electrical level with the constant high-level signal VGH, and the seventh transistor T7 is turned on to keep the electrical level of the Nth gate driving signal G(N) the same with the electrical level of the constant low-level signal VGL after the sixth transistor T6 is turned on.

At stage T2: the (N−2)th clock signal CK(N−2) is at low level. The fourth transistor T4 and the fifth transistor are turned off. The (N−1)th gate driving signal G(N−1) is at high level. The first transistor T1 is turned on. Input of the constant high-level signal VGH pulls up the electrical levels of the first driving signal Q1 and the second driving signal Q2. The third transistor T3 is turned on, meanwhile the eighth transistor T8 is turned on to pull down the electrical level of the cascading reset signal Q3, and the seventh transistor T7 and the ninth transistor T9 are both turned off.

At stage T3: the electrical levels of the first driving signal Q1 and the second driving signal Q2 are keeping at high level because of no leakage path. When the Nth clock signal CK(N) is at high level, the electrical level of the second driving signal Q2 will be pull up to twice the electrical level of the constant high-level VGH by a bootstrap effect of a parasitic capacitance of the sixth transistor T6 itself. The sixth transistor is totally turned on. The Nth gate driving signal G(N) can output with full swing and a waveform will not be weakened.

At stage T4: the (N+1)th gate driving signal G(N+1) is at high level. The second transistor T2 is turned on. The electrical potential of the first driving signal Q1 and the second driving signal Q2 are supplied. The sixth transistor T6 is still turned on. The Nth gate driving signal G(N) can be pull down to the low level suddenly with a small falling edge because the Nth clock signal CK(N) is already at the low level.

At stage T5: the (N−2)th clock signal CK(N−2) is at high level. Repeating stage 1 to pull down the electrical levels of the first driving signal Q1 and the second driving signal Q2. Turning on the seventh transistor T7 to reduce noise continuously about the Nth gate driving signal G(N) to improve anti-interference ability.

In comparison with prior art in FIG. 1 with ten transistors and two capacitors, the GOA circuit one embodiment of the disclosure only includes eleven transistors to reduce types of applying devices and to reduce numbers of applying devices that simplifies manufacturing processes of the GOA circuit at the bezel to realize a narrow bezel design.

Figure 2:
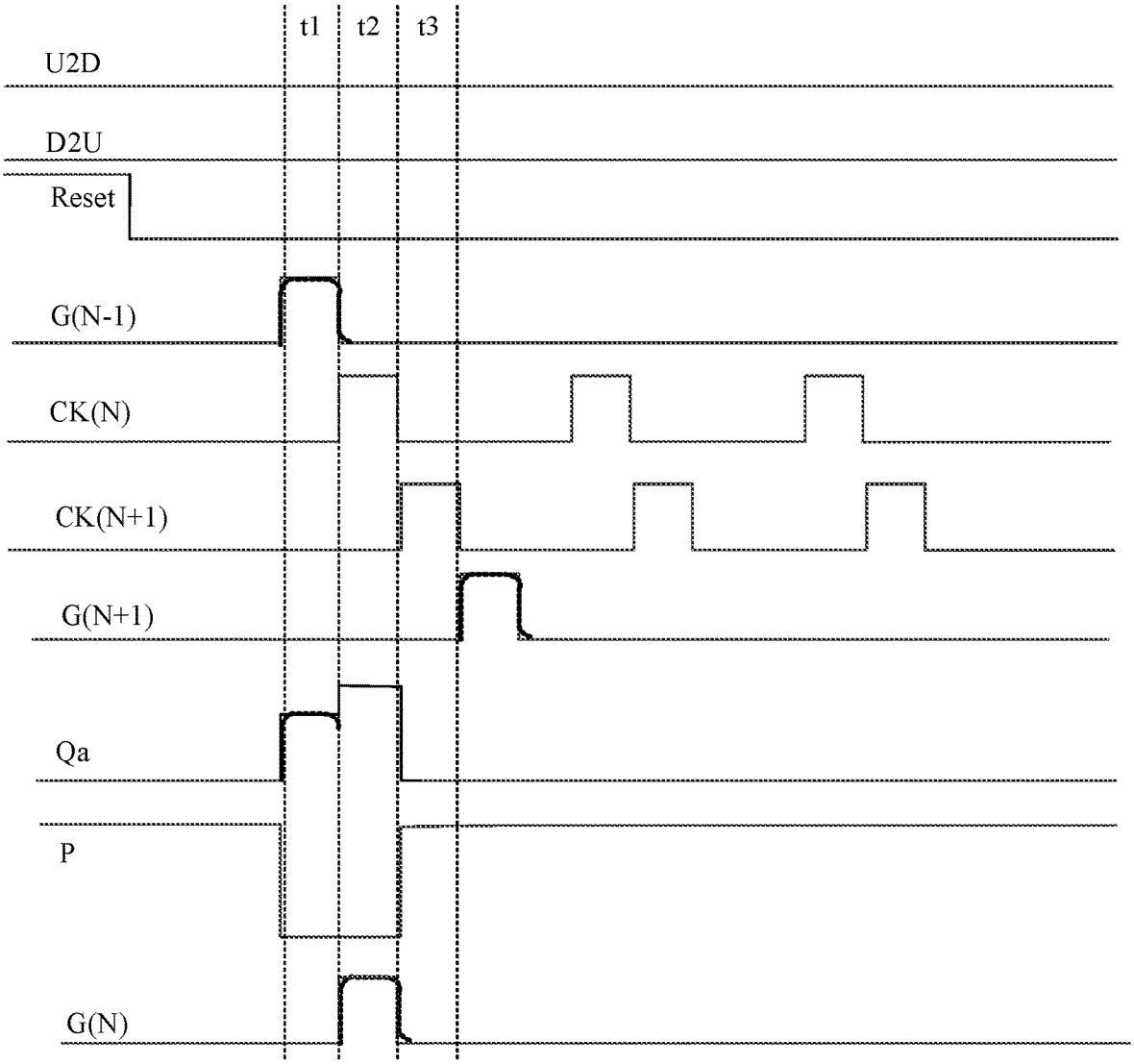
FIG. 2 is a schematic view of a time sequence of the GOA sub-circuit of the GOA circuit according to FIG. 1.

Referring to FIG. 2 and FIG. 6, in one embodiment of the disclosure, the GOA circuit has no capacitor. In comparison with prior art in FIG. 1, when the GOA circuit of the embodiment works in the stage T4, the Nth gate driving signal G(N) can pull down to low level suddenly. In comparison with prior art in FIG. 1, the embodiment reduces the time taken for the falling edge of the Nth gate drive signal G(N) to pull down to the low level. On the other hand, when the (N−2)th clock signal CK(N−2) is valid, the voltage of the gate of the seventh transistor T7 can be pulled up to totally turn on rapidly because the embodiment has no capacitor C2 in prior art. When the (N−2)th clock signal CK(N−2) changes to a low-level state, the gate voltage of the seventh transistor T7 can pull down rapidly to turn off the seventh transistor T7 as soon as possible to avoid signals interference due to change of the data signal before the gate driving signal has turned off with sufficient pixel charging time. With the signals interference, the Nth gate driving signal G(N), also takes as a cascading transmission signal of GOA circuit, will cause a risk of reliability of a product with lots of cascading transmissions. For example, there is more risk of reliability of a product with thousands of cascading transmissions.

Figure 7:
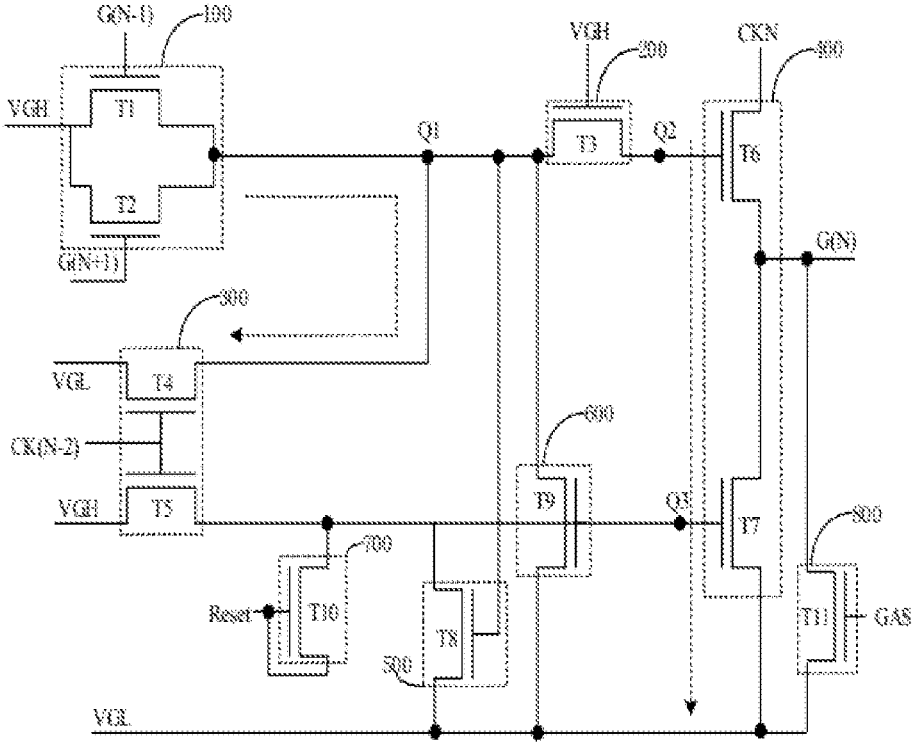
FIG. 7 is a schematic view of a current trend diagram of the GOA sub-circuit of the GOA circuit according to FIG. 5 at an abnormal voltage dropping.
Figure 8:
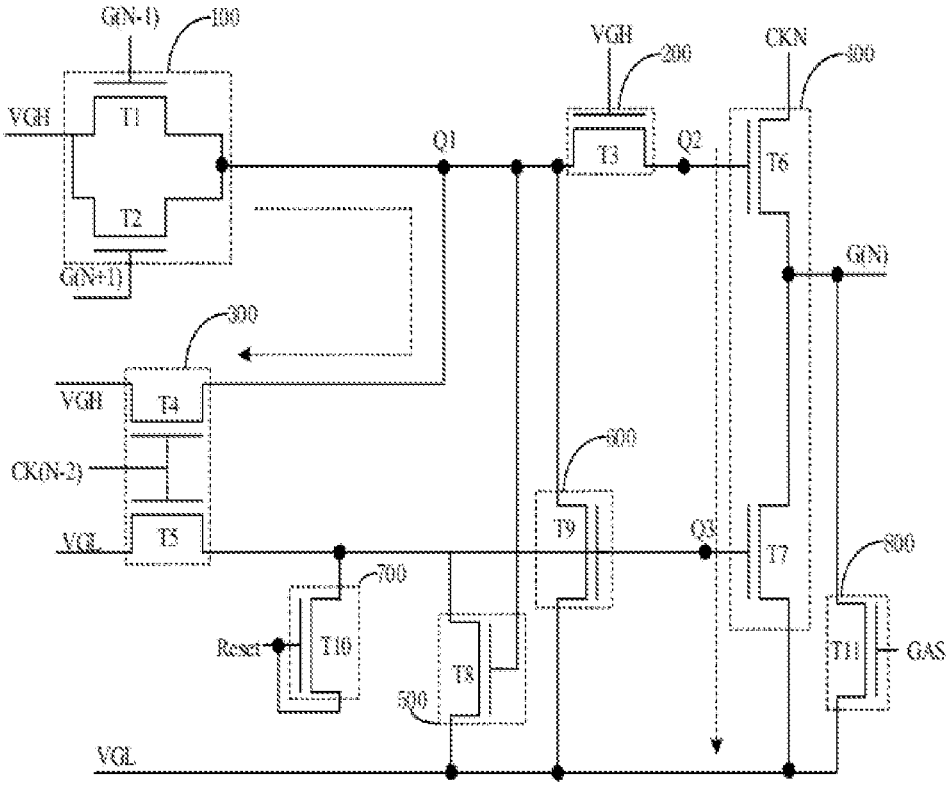
FIG. 8 is a schematic view of a circuit schematic of an abnormal voltage dropping of the GOA sub-circuit of the GOA circuit according to FIG. 5.

Referring to FIG. 7 and FIG. 8, in one embodiment of disclosure, In the using of a product, there is usually an abnormal power-off situation, that is, the product suddenly loses power in an unexpected situation. Since the normal shutdown and discharge steps have not been performed, there will be residual charges in the pixels, which will affect the next boot and normal display. In order to prevent this phenomenon, a time controller will detect this abnormality, turn on the gates of all pixels, and set the data voltage of a column scan to a low level, for example, ground (GND) or a common electrode (VCOM), so that the charge in the pixel will be discharged through the low potential of the data voltage.

The GOA circuit of the disclosure sets all the clock signals to a high level when gates of all the pixels are turned on. The (N−1)th gate driving signal G(N−1) and the (N+1)th gate driving signal G(N+1) are at the high level. The (N−2)th clock signal CK(N−2) is also at the high level. At the moment, the first transistor T1, the second transistor T2, the third transistor T3, the fourth transistor T4, the fifth transistor T5, the sixth transistor T6, the seventh transistor T7, the eighth transistor T8, and the ninth transistor T9 are all turned on to form a current indicated as a dash line arrow in FIG. 7.

Base on above mention, referring to FIG. 8, the drain of the fourth transistor T4 connects with the constant high-level signal VGH, and the drain of the fifth transistor T5 connects the constant low-level signal VGL to solve an abnormal voltage drop. Types of signal required by the GOA circuit at the bezel area are not increasing.

Another embodiment of the disclosure provides a display panel, including the abovementioned GOA circuit.

In the above embodiments, the description of each embodiment has its own emphasis. For a part that is not described in detail in one embodiment, please refer to related descriptions in other embodiments.

The present disclosure of GOA circuit has been described by the above embodiments, but the embodiments are merely examples for implementing the present disclosure. It must be noted that the embodiments do not limit the scope of the invention. In contrast, modifications and equivalent arrangements are intended to be included within the scope of the invention.

What is claimed is:

1. A gate driver on array (GOA) circuit, comprising a plurality of cascading GOA units, wherein one of the GOA units comprises:

a scan control module configured to control a first driving signal output from the scan control module to receive a constant high-level signal according to a (N−1)th gate driving signal and a (N+1)th gate driving signal;

an anti-backfill module connected to the constant high-level signal and the scan control module and configured to obtain a second driving signal from the first driving signal according to control of the constant high-level signal;

a cascading reset module connected to a constant low-level signal, a (N−2)th clock signal, the constant high-level signal, the scan control module, and the anti-backfill module and configured to pull down an electrical level of the first driving signal to an electrical level of the constant low-level signal according to the (N−2)th clock signal and configured to output a cascading reset signal; and a gate signal output module connected to an Nth clock signal, the constant low-level signal, the anti-backfill module, and the cascading reset module and configured to output an Nth gate driving signal according to the second driving signal and the cascading reset signal.

2. The GOA circuit according to claim 1, wherein the GOA unit further comprises a first pull-down module; and wherein the first pull-down module is connected to the scan control module, the cascading reset module, and the constant low-level signal, and configured to pull down an electrical level of the cascading reset signal to the electrical level of the constant low-level signal.

3. The GOA circuit according to claim 2, wherein the GOA unit further comprises a second pull-down module; and wherein the second pull down module is connected to the scan control module, the constant low-level signal, and the cascading reset module and configured to pull down the electrical level of the first driving signal to the electrical level of the constant low-level signal.

4. The GOA circuit according to claim 3, wherein the GOA unit further comprises a system setting module; and wherein the system setting module is connected to the gate signal output module, and the constant low-level signal and configured to pull an electrical level of the Nth gate driving signal to the electrical level of the constant low-level signal according to a system setting signal.

5. The GOA circuit according to claim 4, wherein the scan control module comprises a first transistor and a second transistor; and wherein the constant high-level signal is connected to a drain of the first transistor and a drain of the second transistor, the (N−1)th gate driving signal is connected to a gate of the first transistor, the (N+1)th gate driving signal is connected to a gate of the second transistor, and a source of the first transistor and a source of the second transistor are connected together to output the first driving signal.

6. The GOA circuit according to claim 5, wherein the anti-backfill module comprises a third transistor; and wherein a drain of the third transistor is connected to the source of the first transistor, a gate of the third transistor is connected to the constant high-level signal, and a source of the third transistor is configured to output the second driving signal.

7. The GOA circuit according to claim 6, wherein the cascading reset module comprises a fourth transistor and a fifth transistor; and wherein the constant low-level signal is connected to a drain of the fourth transistor, a source of the fourth transistor is connected to the source of the first transistor, the constant high-level signal is connected to a drain of the fifth transistor, a source of the fifth transistor is configured to output the cascading reset signal, and the (N−2)th clock signal is connected to a gate of the fourth transistor and a gate of the fifth transistor.

8. The GOA circuit according to claim 7, wherein the gate signal output module comprises a sixth transistor and a seventh transistor; and wherein the source of the third transistor is connected to a gate of the sixth transistor, the Nth clock signal is connected to a drain of the sixth transistor, a source of the sixth transistor is connected to a drain of the seventh transistor to output the Nth gate driving signal, a gate of the seventh transistor is connected to the source of the fifth transistor, and a source of the seventh transistor is connected to the constant low-level signal.

9. The GOA circuit according to claim 8, wherein the system setting module comprises an eleventh transistor; and wherein a drain of the eleventh transistor is connected to the source of the sixth transistor, a source of the eleventh transistor is connected to the constant low-level signal, and a gate of the eleventh transistor is configured to receive the system setting signal.

10. A gate driver on array (GOA) circuit, comprising a plurality of cascading GOA units, wherein one of the GOA units comprises:

a scan control module configured to control a first driving signal output from the scan control module to receive a constant high-level signal according to a (N−1)th gate driving signal and a (N+1)th gate driving signal;

an anti-backfill module connected to the constant high-level signal and the scan control module and configured to obtain a second driving signal from the first driving signal according to control of the constant high-level signal;

a cascading reset module connected to a constant low-level signal, a (N−2)th clock signal, the constant high-level signal, the scan control module, and the anti-backfill module and configured to pull down an electrical level of the first driving signal to an electrical level of the constant low-level signal according to the (N−2)th clock signal and configured to output a cascading reset signal; and a gate signal output module connected to an Nth clock signal, the constant low-level signal, the anti-backfill module, and the cascading reset module and configured to output an Nth gate driving signal according to the second driving signal and the cascading reset signal;

wherein the GOA unit further comprises a system reset module; and the system reset module is connected to the cascading reset module and configured to pull up an electrical level of the cascading reset signal to an electrical level of a system reset signal according to the system reset signal.

11. The GOA circuit according to claim 10, wherein the GOA unit further comprises a first pull-down module; and wherein the first pull-down module is connected to the scan control module, the cascading reset module, and the constant low-level signal, and configured to pull down an electrical level of the cascading reset signal to the electrical level of the constant low-level signal.

12. The GOA circuit according to claim 11, wherein the GOA unit further comprises a second pull-down module; and wherein the second pull down module is connected to the scan control module, the constant low-level signal, and the cascading reset module and configured to pull down the electrical level of the first driving signal to the electrical level of the constant low-level signal.

13. The GOA circuit according to claim 12, wherein the GOA unit further comprises a system setting module; and wherein the system setting module is connected to the gate signal output module, and the constant low-level signal and configured to pull an electrical level of the Nth gate driving signal to the electrical level of the constant low-level signal according to a system setting signal.

14. The GOA circuit according to claim 13, wherein the scan control module comprises a first transistor and a second transistor; and wherein the constant high-level signal is connected to a drain of the first transistor and a drain of the second transistor, the (N−1)th gate driving signal is connected to a gate of the first transistor, the (N+1)th gate driving signal is connected to a gate of the second transistor, and a source of the first transistor and a source of the second transistor are connected together to output the first driving signal.

15. The GOA circuit according to claim 14, wherein the anti-backfill module comprises a third transistor; and wherein a drain of the third transistor is connected to the source of the first transistor, a gate of the third transistor is connected to the constant high-level signal, and a source of the third transistor is configured to output the second driving signal.

16. The GOA circuit according to claim 15, wherein the cascading reset module comprises a fourth transistor and a fifth transistor; and wherein the constant low-level signal is connected to a drain of the fourth transistor, a source of the fourth transistor is connected to the source of the first transistor, the constant high-level signal is connected to a drain of the fifth transistor, a source of the fifth transistor is configured to output the cascading reset signal, and the (N-2)th clock signal is connected to a gate of the fourth transistor and a gate of the fifth transistor.

17. The GOA circuit according to claim 16, wherein the gate signal output module comprises a sixth transistor and a seventh transistor; and wherein the source of the third transistor is connected to a gate of the sixth transistor, the Nth clock signal is connected to a drain of the sixth transistor, a source of the sixth transistor is connected to a drain of the seventh transistor to output the Nth gate driving signal, a gate of the seventh transistor is connected to the source of the fifth transistor, and a source of the seventh transistor is connected to the constant low-level signal.

18. The GOA circuit according to claim 17, wherein the first pull-down module comprises an eighth transistor; and wherein a drain of the eighth transistor is connected to the source of the fifth transistor, a source of the eighth transistor is connected to the constant low-level signal, and a gate of the eighth transistor is connected to the source of the first transistor.

19. The GOA circuit according to claim 18, wherein the second pull-down module comprises a ninth transistor; and wherein a drain of the ninth transistor is connected to the source of the first transistor, a source of the ninth transistor is connected to the constant low-level signal, and a gate of the ninth transistor is connected to the source of the fifth transistor.

20. A display panel, comprising a gate driver on array (GOA) circuit, wherein the GOA circuit comprises a plurality of cascading GOA units, and one of the GOA units comprises:

a scan control module configured to control a first driving signal output from the scan control module to receive a constant high-level signal according to a (N−1)th gate driving signal and a (N+1)th gate driving signal;

an anti-backfill module connected to the constant high-level signal and the scan control module and configured to obtain a second driving signal from the first driving signal according to control of the constant high-level signal;

a cascading reset module connected to a constant low-level signal, a (N−2)th clock signal, the constant high-level signal, the scan control module, and the anti-backfill module and configured to pull down an electrical level of the first driving signal to an electrical level of the constant low-level signal according to the (N−2)th clock signal and configured to output a cascading reset signal; and a gate signal output module connected to an Nth clock signal, the constant low-level signal, the anti-backfill module, and the cascading reset module and configured to output an Nth gate driving signal according to the second driving signal and the cascading reset signal.

* * * * *